US006991519B2

(12) United States Patent
Laycock

(10) Patent No.: US 6,991,519 B2
(45) Date of Patent: Jan. 31, 2006

(54) ANGLE HEAD GRINDING METHOD

(75) Inventor: Michael Laycock, West Yorkshire (GB)

(73) Assignee: Unova UK Limited, Buckinghamshire (GB)

( * ) Notice: Subject to any disclaimer, the term of this patent is extended or adjusted under 35 U.S.C. 154(b) by 2 days.

(21) Appl. No.: 10/955,362

(22) Filed: Sep. 30, 2004

(65) Prior Publication Data

US 2005/0095961 A1 May 5, 2005

Related U.S. Application Data

(62) Division of application No. 09/890,181, filed as application No. PCT/GB00/00022 on Jan. 7, 2000, now Pat. No. 6,893,324.

(30) Foreign Application Priority Data

Jan. 3, 1999 (GB) ..... 9902256

(51) Int. Cl.
*B24B 1/00* (2006.01)
*B24B 3/12* (2006.01)

(52) U.S. Cl. ..... 451/21; 451/5; 451/10; 451/46; 451/56; 451/410

(58) Field of Classification Search ..... 451/5, 451/10, 11, 21, 46, 51, 49, 56, 55, 58, 72, 451/253, 407, 410, 124, 127, 150, 178
See application file for complete search history.

(56) References Cited

U.S. PATENT DOCUMENTS 4,175,537 A * 11/1979 Wiener ..... 125/11.03
4,475,319 A * 10/1984 Wirz ..... 451/5
4,527,356 A 7/1985 Ozone et al.
4,709,509 A 12/1987 Yoneda et al.
4,747,236 A 5/1988 Wedeniwski
4,848,038 A 7/1989 Maruyama et al.
4,885,874 A 12/1989 Wedeniwski
4,905,418 A 3/1990 Wedeniwski
4,942,695 A 7/1990 Wedeniwski
5,045,664 A 9/1991 Nakagawa et al.
5,183,026 A * 2/1993 Ohta et al. ..... 125/11.16
5,251,405 A 10/1993 Clauss et al.
5,259,150 A 11/1993 Himmelsbach
5,272,843 A * 12/1993 Maruyama et al. ..... 451/21
5,315,789 A 5/1994 Takashi
5,355,633 A 10/1994 Ishikawa et al.

(Continued)

FOREIGN PATENT DOCUMENTS

DE 1577485 9/1971

(Continued)

OTHER PUBLICATIONS

7-Achsen-Schleifzentrum Fuer Simultanes Innen-Und Aussenschleifen, VDI Z,DE, VDI Verlag GMBH, Dusseldorf, vol. 132, No. 7, Jul. 1, 1990, p. 92 XP 000136011.

(Continued)

*Primary Examiner*—Lee D. Wilson
*Assistant Examiner*—Anthony Ojini
(74) *Attorney, Agent, or Firm*—Reising, Ethington, Barnes, Kisselle, P.C.

(57) ABSTRACT

A computer controlled grinding machine grinds a cylindrical region and an annular shoulder of a rotatable workpiece. Relative movement is effected between the workpiece and a grinding wheel along a line of action which subtends an angle of approach of less than 90 degrees to the Z axis of rotation of the workpiece. Such an angle of approach enables the wheel to grind the annular shoulder of the workpiece simultaneously with grinding the cylindrical portion.

11 Claims, 2 Drawing Sheets

U.S. PATENT DOCUMENTS

| | | | | |
|---|---|---|---|---|
| 5,392,566 | A | 2/1995 | Wedeniwski | |
| 5,453,037 | A | 9/1995 | Lehmann | |
| 5,533,931 | A * | 7/1996 | Imai et al. | 451/11 |
| 5,562,523 | A * | 10/1996 | Asano et al. | 451/1 |
| 5,595,525 | A | 1/1997 | Hayashi et al. | |
| 5,620,358 | A * | 4/1997 | Furukawa et al. | 451/22 |
| 5,746,643 | A | 5/1998 | Terasaki et al. | |
| 5,899,797 | A | 5/1999 | Junker | |
| 5,954,568 | A * | 9/1999 | Wirz | 451/47 |
| 5,975,995 | A | 11/1999 | Hykes et al. | |
| 6,077,150 | A * | 6/2000 | Jankowski | 451/47 |
| 6,200,200 | B1 | 3/2001 | Himmelsbach | |
| 6,491,568 | B1 * | 12/2002 | Jankowski | 451/5 |

FOREIGN PATENT DOCUMENTS

| | | |
|---|---|---|
| EP | 0169971 A | 2/1986 |
| EP | 0257194 A | 3/1988 |
| EP | 0480269 | 4/1992 |
| WO | WO 95/03912 | 2/1995 |

OTHER PUBLICATIONS

7-Achsen-Schleifzentrum Fuer Simultanes Innen-Und Aussenschleifen, VDI Z,DE, VDI Verlag GMBH, Dusseldorf, vol. 132, No. 7, Jul. 1, 1990, English Translation.

* cited by examiner

ANGLE HEAD GRINDING METHOD

This application is a divisional of prior application Ser. No. 09/890,181, filed Dec. 27, 2001 now, U.S. Pat. No. 6,893,324, which is a 371 of PCT/GB00/00022, filed Jan. 7, 2000.

FIELD OF INVENTION

This invention concerns angle head grinding in which surfaces perpendicular and parallel to an axis of rotation are ground simultaneously by a single grinding wheel.

BACKGROUND TO THE INVENTION

EP0505836 describes an angular grinding wheel for simultaneously grinding a cylindrical surface and a radial end surface, or shoulder, of a workpiece. Much of the disclosure in EP 0505836 is concerned with the gauging and dressing of the two perpendicular grinding surfaces Ga and Gb around the periphery of the wheel so as to ensure that as the surface Ga removes material from a cylindrical region of the workpiece and the latter moves in a direction parallel to the Z-axis, just the right amount of material is ground away from the end face of the adjoining shoulder as the proximate cylindrical region is ground by the perpendicular face Ga, so as to leave a correctly sized and ground shoulder. In order to achieve this, reference surfaces RSa and RSb are provided on the grinding wheel and complex gauging and dressing steps are required to ensure that the surface Gb is of sufficient extent (measured parallel to the X-axis) as to extend radially beyond the shoulder so as to ensure that no undercutting of the shoulder can occur.

It is an object of the present invention to provide an alternative grinding method and apparatus for angle head grinding which obviates the need for much of the complex gauging and wheel dressing such as is required using a process and apparatus such as described in EP0505836. apparatus which allows angle head grinding to be performed without the need for special wheels and which can be performed without the need for movement of the workpiece parallel to the Z-axis.

SUMMARY OF THE INVENTION

According to one aspect of the present invention, a conventional grinding wheel is mounted on a grinding machine wheelhead for movement parallel to the X and Z-axes of the machine (where the Z-axis is the axis of rotation of the workpiece and the X-axis is perpendicular thereto), and wherein the wheel is mounted for rotation about an axis which remains parallel to the workpiece axis of rotation, X and Z-axis drive means are provided for moving the wheelhead relative to the workpiece parallel to the X and Z axes respectively, and control signals for determining the advance along the X and Z axes are derived from a programmed computer which causes the wheelhead to advance towards and into engagement with the workpiece along a line of action which subtends an angle of less than 90 degrees to the Z-axis, the angle of approach being such as to simultaneously plunge grind an annular shoulder at an end of the cylindrical surface and to grind the cylindrical surface adjoining the shoulder during a single advance of the wheel towards the workpiece.

Typically the line of action achieved by the two X and Z movements of the wheelhead is 45 degrees to the Z-axis. However different angles of approach may be employed. For example where the amount of material to be removed from the cylindrical surface is greater than that to be removed from the adjoining shoulder, the angle may be less than 45 degrees. Where the reverse is the case, the angle may for example be greater than 45 degrees.

This aspect of the invention also lies in a method of simultaneously cylindrical and face grinding a workpiece using a conventional grinding wheel wherein a wheelhead on which the grinding wheel is mounted is moved simultaneously parallel to and perpendicular to the axis of rotation of the workpiece so as to define a line of action along which the wheelhead moves towards and into engagement with the workpiece to perform a single plunge grind along that line of action, the amount of material removed from the cylindrical and radial faces of the workpiece by engagement with the grinding wheel being just sufficient to form the shoulder and adjoining cylindrical surface in the single plunge grinding operation.

It is an advantage of the method and apparatus proposed by this aspect of the invention that a conventional grinding wheel mounted for rotation about an axis which remains parallel to the workpiece axis of rotation, can be used for this purpose so that where the cylindrical surface which is to be ground extends over an axially greater distance than that corresponding to the width of the wheel, as will normally be the case, the cylindrical surface can be ground in a conventional manner such as by means of a series of adjacent plunge grinds leaving an annulus of unground material which extends axially over a distance which is less than the width of the wheel from an adjoining radial shoulder which is to be ground to size, where-after the wheelhead is advanced along a line of action selected in accordance with the invention so as to remove the unground annulus and grind the adjoining radial face to size in a single plunge grind along the said selected line of action.

This first aspect of the invention also lies in a computer controlled grinding machine when programmed to advance a wheelhead carrying a conventional grinding wheel mounted for rotation about an axis which remains parallel to the workpiece axis of rotation, along a selected line of action into engagement with a workpiece where the line of action extends at an angle of less than 90 degrees to the axis of rotation of the workpiece, so that unground material forming part of cylindrical surface of the workpiece and an adjoining radial end face of the workpiece can be ground in a single plunge grind, in which the wheelhead moves along the said line of action into engagement with the workpiece and away therefrom after grinding.

According to a second aspect of the invention, in a grinding machine in which a conventional grinding wheel is carried on a wheelhead which is itself adapted for movement along a first-axis, a workpiece is rotated about a second perpendicular axis, the Z-axis, and is mounted on a carriage which is movable parallel to the Z-axis, and wherein the wheel rotates about an axis which remains parallel to the workpiece axis of rotation, and an X-axis drive is provided for advancing and retracting the wheelhead parallel to the X-axis and a Z-axis drive is provided for moving the carriage parallel to the Z-axis, and signals are derived for controlling the X and Z axis drives from a computer which is programmed to generate appropriate X and Z axis drive control signals to produce simultaneous movement of the wheelhead and workpiece such that the movement of the wheelhead relative to the workpiece is along a line of action which subtends an angle with the Z-axis which is less than 90 degrees, whereby the external cylindrical surface of the grinding wheel serves to remove material from the cylindrical surface of the workpiece and an adjoining circular face of the wheel engages the said radial shoulder of the workpiece to grind the latter to size as the wheelhead is advanced along the said line of action.

This second aspect of the invention also lies in a method of simultaneously grinding cylindrical and radial faces of a workpiece using a conventional grinding wheel in which the latter is advanced along a line which is perpendicular to the axis of rotation of the workpiece but which rotates about an axis which remains parallel to the workpiece axis of rotation throughout, and the workpiece is moved axially in a direction parallel to the axis about which the wheel is rotating, so that the movement of the grinding wheel relative to the workpiece is along a line of action which subtends an angle of less than 90 degrees to the axis of rotation of the workpiece, so that the external cylindrical surface of the grinding wheel will remove material from the cylindrical surface of the workpiece to be ground, and an adjoining circular face of the wheel will engage and remove material from the radial face of the workpiece, and the angle made by the line of action relative to the axis of rotation is selected so that just the desired amount of material is removed from the said radial face, as the external cylindrical surface of the wheel removes material from the cylindrical face of the workpiece to bring it to size.

This second aspect of the invention also lies in a computer controlled grinding machine in which a workpiece is movable by means of a carriage along an axis parallel to the axis of rotation of the workpiece and perpendicular to the direction of advance and retraction of a wheelhead carrying a grinding wheel in which the wheel is mounted for rotation about an axis which throughout remains parallel to the workpiece axis of rotation, when programmed to move the wheelhead and the workpiece carriage along the two orthogonal directions so as to produce a net movement of the wheelhead relative to the workpiece along a line of action which subtends an angle of less than 90 degrees, relative to the axis of rotation of the workpiece.

Where the plunge grinding can be performed quickly it is not essential to ensure that cooling fluid flows reliably over the grinding wheel and the workpiece surfaces. However where it is desirable to introduce coolant so as to restrict the rise in temperature of the wheel or the workpiece or both, a third aspect of the invention provides a modified grinding wheel for use in either of the methods and apparatus described in relation to the first and second aspects of the invention, wherein the external edge face of the grinding wheel is formed so as to provide two grinding faces of which one parallel to the axis about which the wheel rotates, but which comprise first and second frusto-conical surfaces, the first frusto-conical grinding face being perpendicular to the second frustoconical grinding face, and the grinding wheel is mounted for rotation about an axis which makes the same angle with the axis of rotation of the workpiece as the first frusto-conical surface makes with the axis of rotation of the grinding wheel, so that the said first frusto-conical surface will cylindrically grind the cylindrical workpiece surface, and the wheel is mounted on a wheelhead which itself is movable at least perpendicularly to the axis of rotation of the workpiece and can either be moved parallel to the axis of rotation of the workpiece, with separate drives to produce the said two perpendicular movements, to advance the grinding wheel towards the workpiece along a line of action which is perpendicular to the axis of rotation of the wheel, or the workpiece is mounted on a carriage which itself is slidable parallel to the axis of rotation of the workpiece, and drive means is provided for moving the said carriage, and the wheelhead and carriage drive means are operated so as to achieve the same relative movement between the wheel and the workpiece, along the said line of action, so that however it is moved, the wheel moves into engagement with the workpiece along the said line of action, and coolant is dispensed into the workpiece engaging region at least between the said second frusto-conical grinding surface and the radial shoulder of the workpiece being ground.

According to this third aspect of the invention, in a method of simultaneously grinding cylindrical and radial surfaces of a workpiece, a grinding wheel having two perpendicular frusto-conical grinding faces around its periphery is mounted for rotation about an axis which is co-axial with the coincident axes of the two cones of which the frusto-conical grinding surfaces form a part, the grinding wheel is mounted on a wheelhead so that one of the said orthogonal frusto-conical grinding surfaces will cylindrically grind a cylindrical surface of the workpiece, and relative movement is effected between the wheelhead and the workpiece so that the wheel engages the workpiece with the said one of the frusto-conical surfaces engaging to the cylindrical workpiece surface, and the other frusto-conical surface simultaneously engaging the radial surface which is to be ground, and a single plunge grind is performed along the line of action defined by the said relative movement such that just the required amount of material is removed from the two orthogonal surfaces of the workpiece as to leave both ground to size after the single plunge grind, and coolant fluid is directed into the region of engagement between at least one pair of grinding and workpiece surfaces.

The third aspect of the invention also lies in a computer controlled grinding machine having a grinding wheel mounted on a wheelhead thereon for rotation about an axis which is coaxial with the coincident axes of two orthogonal frusto-conical surfaces formed around the periphery of the grinding wheel, wherein the machine is programmed to produce relative movement between the wheelhead and the workpiece along a line of action which is perpendicular to the axis of rotation of the wheel so that a single plunge grind will remove material from a radial and a cylindrical surface of the workpiece simultaneously.

Whereas it is generally unnecessary to dress a conventional grinding wheel other than to maintain a true surface around the periphery of the wheel for grinding, the modified grinding wheel proposed by the third aspect of the invention may involve the need to dress at least one if not both of the frusto-conical grinding surfaces, particularly that which engages a workpiece face.

The invention will now be described by way of example, with reference to the accompanying drawings in which the three figures illustrates the three different aspects of the invention.

DETAILED DESCRIPTION OF THE INVENTION

Figure 1:
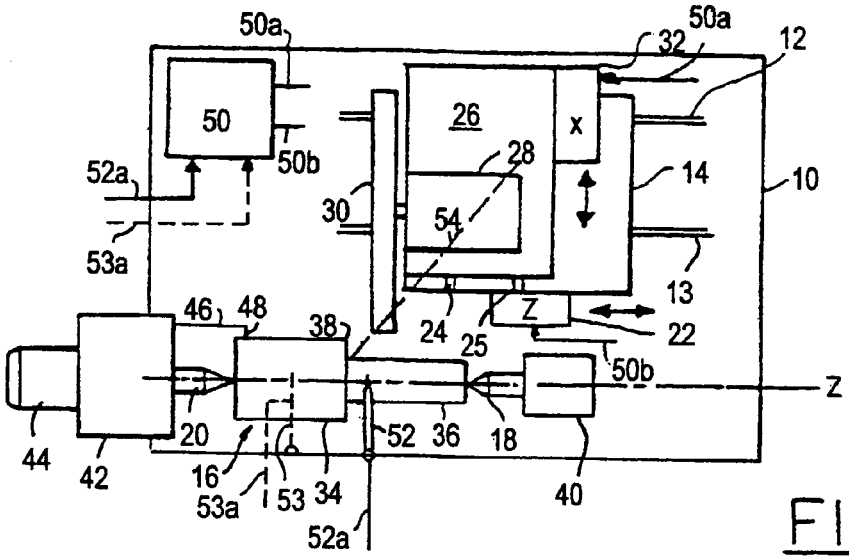
FIG. 1 is a schematic top view of a grinding machine according to the invention.

In FIG. 1 the bed of a grinding machine 10 has mounted thereon a slideway 12, 13 on which a Z-axis platform 14 is mounted for movement parallel to the Z-axis, i.e. the axis of rotation of a workpiece generally designated 16 carried between centers 18 and 20. A Z-axis drive 22 moves the platform 14 on the slideway 12, 13 to position the platform axially relative to the Z-axis and therefore the workpiece 16.

Carried on a second slideway 24, 25 is a wheelhead 26 on which is mounted a motor 28 carrying a large diameter conventional grinding wheel 30. An X-axis drive 32 serves to move the wheelhead 26 perpendicular to the Z-axis along the slideway 24, 25 to advance and retract the wheel 30.

The workpiece 16 includes two cylindrical regions 34 and 36 with a radial shoulder 38 between the larger diameter region 34 and the smaller diameter region 36. The centre 18 extends from a fixed tailstock 40 and the centre 20 from a headstock 42 which includes a rotational drive motor 44 and driving device 46 for engaging a pin 48 which protrudes from the larger diameter end 34 of the workpiece 16. The engagement between 46 and 48 causes the workpiece to be rotated relative to the centers 18 and 20 around the Z-axis.

A computer 50 provides control signals for the X and Z drives and receives signals from one or more gauges such as 52 and optionally 53 to control the motion of the platform 14 and wheelhead 26 carried thereon so that the wheelhead and therefore the grinding wheel 30 moves relative to the machine 10 along the dotted line 54.

The computer 50 is programmable so as to alter the angle that line 54 makes to the Z-axis and is also programmable so as to perform conventional plunge grinding to cylindrically grind one or both of the cylindrical regions 34 and 36 of the workpiece as required.

Figure 1A:
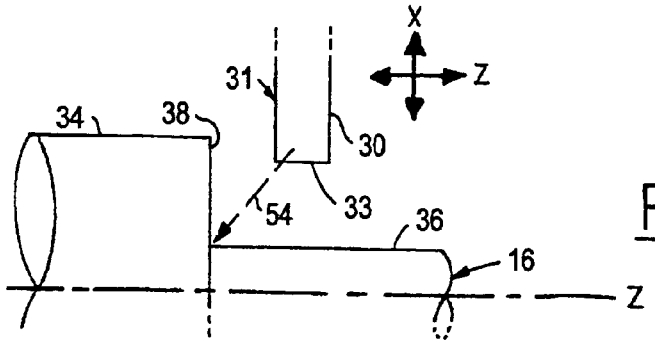
FIG. 1A is a detail view of FIG. 1 showing the grinding wheel and the workpiece.

FIG. 1A shows in larger scale the movement of the grinding wheel 30 towards the junction between the smaller diameter region 36 and the larger diameter region 34 of the workpiece 16 shown in FIG. 1. The direction of movement between the grinding wheel 30 and the workpiece is shown by the dotted line 54 in FIG. 1A.

Figure 2:
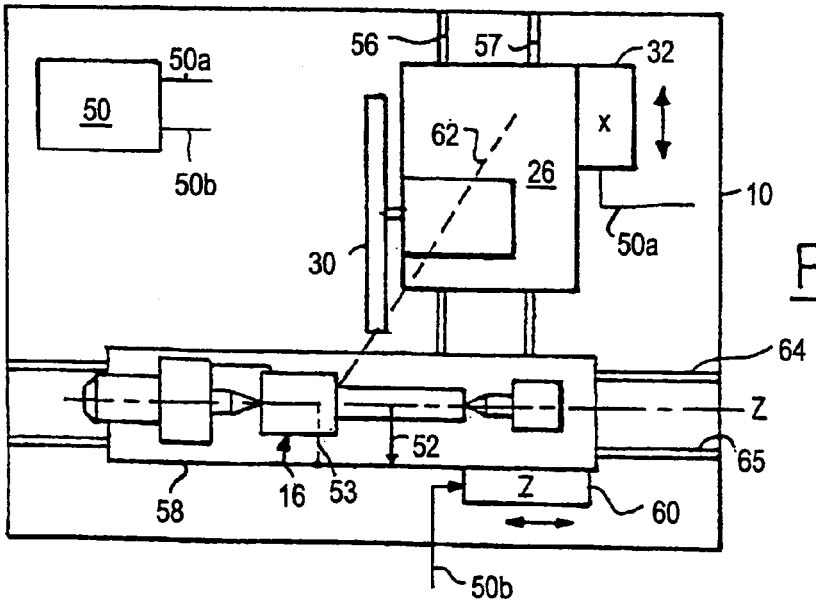
FIG. 2 is a schematic top view of a second embodiment of the invention.

FIG. 2 is similar to that of FIG. 1 except that the wheelhead is mounted for movement parallel to the X direction only on two slideways 56 and 57 carried by the machine 10. Movement parallel to the Z-axis is achieved by mounting the tailstock and headstock on a carriage 58 having its own Z drive 60.

Relative movement between the wheel 30 and the workpiece generally designated 16 is achieved so as to describe a similar movement to that of FIG. 1 along a line such as 62 (shown in FIG. 2), by supplying appropriate signals from a computer 50 to the X and Z drives 32 and 60 so that as the wheelhead 26 is moved towards the workpiece, so the carriage 58 is moved along the Z-axis.

To this end the carriage is slidable on a second slideway 64, 65 also mounted on the machine 10.

Figure 3:
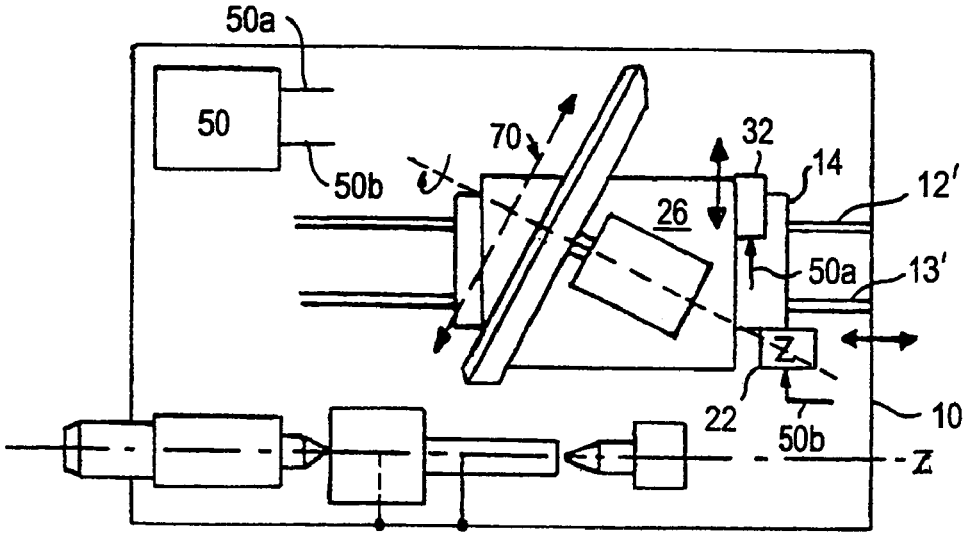
FIG. 3 is a schematic top view of a third embodiment of the invention.

FIG. 3 is similar to FIG. 1 in that a grinding wheel is carried by a wheelhead 26 having an X-axis drive 32 for movement perpendicular to the Z-axis on a slideway (not shown) carried by a platform 14', itself slidable on rails 12' and 13' carried by the machine 10. A Z-axis drive 22 moves the platform 14' along the rails 12', 13' parallel to the Z-axis.

A computer 50 provides appropriate control signals for the X and Z drives 32 and 22 so that the wheelhead 26 describes a path parallel to the dotted line 70 so as to bring the wheel into engagement with the workpiece.

Figure 3A:
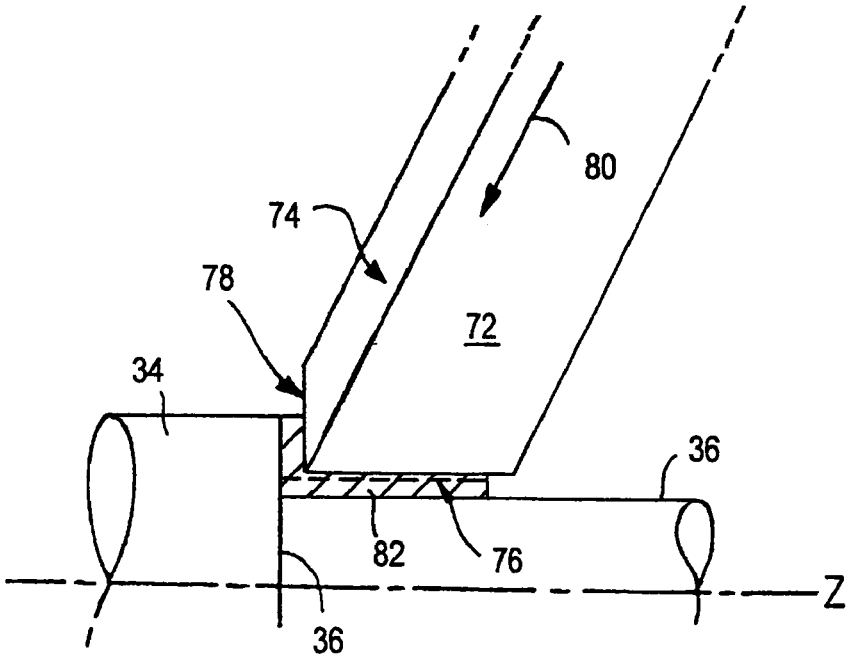
FIG. 3A is a detail view of FIG. 3 showing the grinding wheel and the workpiece.

As best seen in FIG. 3A, the grinding wheel edge is formed to provide major and minor frusto-conical grinding surfaces 72 and 74 respectively. The two surfaces are orthogonal so that when viewed on edge, the two surfaces define two perpendicular edges 76 and 78 which are parallel respectively to the smaller diameter cylindrical surface 36 and the radial surface 38 between it and the larger diameter workpiece region 34. By moving the grinding wheel in the direction of the arrow 80 towards the vertex between the radial surface 38 and the cylindrical surface 36, so material can be removed from the workpiece in a single plunge grind. Material still to be removed by the plunge grind is shown in the cross-hatched area 82 between the two frusto-conical surfaces 72 and 74, and the workpiece.

It is to be understood that the modified grinding wheel shown in FIGS. 3 and 3A can also be used to remove material from the cylindrical surface 36 and/or the surface 34 away from the shoulder 38 by plunge grinding so as to bring the frustoconical surface 72 into grinding contact with the cylindrical surfaces of the workpiece as appropriate.

Referring back to FIG. 1A, it will be seen that if the grinding wheel 30 is moved closer in towards the shoulder 38 and cylindrical surface 36 along the line 54 as previously described, a point will be reached where the circular face 31 of the grinding wheel 30 will come into contact with a material which is to be removed from the shoulder 38 and the cylindrical surface 33 of the wheel 30 will simultaneously come into contact with the material which is to be removed from the cylindrical surface 36 so that continued movement along the line 54 will simultaneously remove material from the shoulder 38 and the region 36 of the workpiece until the vertex is reached and the material forming the surface 36 has been ground to size and the shoulder 38 ground back to the desired axial position along the length of the workpiece by engagement with the face 31.

In each of the cases described the grinding wheel is typically comprised of a central circular core and an abrasive annular layer containing CBN grit although it is to be understood that any other appropriate grinding material may be employed. It is of course necessary for the annular region of the grinding grit to extend radially inwardly by more than the radial depth of the shoulder which is to be ground such as 38 and in the case of the angular wheel such as shown in FIGS. 3 and 3A, needs to have a sufficient depth to enable the two frustoconical surfaces to be formed.

Since wear will occur and there will be a need to redress some of the surfaces of the wheel as it is used, the annulus is of sufficient radial extent to accommodate the anticipated wear and redressing requirements so as to give the wheel a useful life before it has to be demounted and replaced.

What is claimed is:

1. A method of simultaneously grinding cylindrical and radial surfaces of a workpiece in a single operation using a conventional grinding wheel comprising the steps of:

simultaneously moving a wheelhead on which the grinding wheel is mounted both parallel to and perpendicular to the axis of rotation of the workpiece to define a line of action along which the wheelhead moves towards and into engagement with the workpiece;

performing a single plunge grind operation along that line of actions; and, removing an amount of material from the cylindrical and radial surfaces of the workpiece by engagement with the grinding wheel that is just sufficient to form the shoulder and adjoining cylindrical surface in said single operation.

2. A method according to claim 1 in which the cylindrical surface which is to be ground extends over an axially greater distance than that corresponding to the width of the wheel, the method further comprising the steps of:

grinding the cylindrical surface in a conventional manner, such as by means of a series of adjacent plunge grinds;

leaving an annulus of unground material which extends axially over a distance which is less than the width of the wheel from an adjoining radial shoulder which is to be ground to size; and, advancing the wheelhead along a selected line of action so as to remove the unground annulus and grind the adjoining radial surface to size in a single plunge grind along the said selected line of action.

3. A method of simultaneously grinding cylindrical and radial surfaces of a workpiece in which a grinding wheel having two perpendicular frusto-conical grinding faces around its periphery is mounted for rotation about an axis which is coaxial with the coincident axes of the two cones of which the frusto-conical grinding surfaces form a part, the method comprising the steps of:

mounting the grinding wheel on a wheelhead so that one of the said orthogonal frusto-conical grinding faces will cylindrically grind a cylindrical surface of the workpiece;

effecting relative movement between the wheelhead and the workpiece so that the wheel engages the workpiece with the said one of the frusto-conical faces engaging the cylindrical workpiece surface, and the other frusto-conical face simultaneously engaging the radial surface which is to be ground; and, performing a single plunge grind along the line of action defined by the said relative movement such that just the required amount of material is removed from the two orthogonal surfaces of the workpiece to leave the two orthogonal surfaces ground to size after the single plunge grind.

4. A method according to claim 3 further comprising the step of dressing at least one of the frusto-conical grinding faces.

5. The method of claim 4 wherein the step of dressing is applied to the frusto-conical face of the grinding wheel that engages a radial surface of the workpiece.

6. The method of claim 4 further comprising the step of dressing both frusto-conical faces of the grinding wheel.

7. The method of claim 3 further comprising the step of simultaneously moving the wheelhead both parallel to and perpendicular to the axis of rotation of the workpiece.

8. The method of claim 7 further comprising the step of mounting the grinding wheel so that the movement of the grinding wheel is along a line of action which is perpendicular to the axis of rotation of the wheel.

9. The method of claim 3 further comprising the step of directing coolant fluid into the region of engagement between at least one grinding face and workpiece surface.

10. A method of simultaneously grinding cylindrical and radial surfaces of a workpiece using a conventional grinding wheel comprising the steps of:

advancing the wheel along a line which is perpendicular to the axis of rotation of the workpiece;

rotating the wheel about an axis which remains parallel to the workpiece axis of rotation throughout the grinding process;

moving the workpiece axially in a direction parallel to the axis about which the wheel is rotating, so that the movement of the grinding wheel relative to the workpiece is along a line of action which subtends an angle of less than 90° to the axis of rotation of the workpiece;

removing material from the cylindrical surface of the workpiece to be ground with the external cylindrical face of the grinding wheel;

engaging an adjoining circular surface of the wheel with the radial surface of the workpiece to remove material from the radial surface of the workpiece, and selecting the angle made by the line of action relative to the axis of rotation so that just the desired amount of material is removed from the said radial surface of the workpiece at the same time that the external cylindrical face of the wheel removes material from the cylindrical surface of the workpiece to bring it to size.

11. The method of simultaneously grinding cylindrical and radial surfaces of a workpiece of claim 10, wherein the wheel is advanced along a line which is perpendicular to the axis of rotation of the wheel.

* * * * *

UNITED STATES PATENT AND TRADEMARK OFFICE

CERTIFICATE OF CORRECTION

PATENT NO. : 6,991,519 B2
DATED : January 31, 2006
INVENTOR(S) : Laycock

It is certified that error appears in the above-identified patent and that said Letters Patent is hereby corrected as shown below:

Column 1,
Line 38, after "EP0505836." insert -- it is also an object of the invention to provide a method and --.

Column 2,
Line 44, after "part of" insert -- the --.

Column 6,
Line 62, after "that line of" delete "actions" and insert -- action --.

Signed and Sealed this

Sixteenth Day of May, 2006

JON W. DUDAS
*Director of the United States Patent and Trademark Office*